United States Patent [19]

Sampson

[11] 4,211,394

[45] Jul. 8, 1980

[54] LOG CLAMPING APPARATUS

[76] Inventor: Harold J. Sampson, 636 California Way, Space 111, Longview, Wash. 98632

[21] Appl. No.: 47,034

[22] Filed: Jun. 11, 1979

[51] Int. Cl.[2] ..... B25B 1/04

[52] U.S. Cl. ..... 269/239; 144/2 Z; 144/312; 269/268

[58] Field of Search ..... 144/2 Z, 3 D, 312; 269/239, 268

[56] References Cited

U.S. PATENT DOCUMENTS

| | | | |
|---|---|---|---|
| 3,398,774 | 8/1968 | Hahn | 144/2 Z |
| 3,693,679 | 9/1972 | Pierrot | 144/2 Z |
| 4,130,151 | 12/1978 | Ericsson | 144/2 Z |
| 4,161,200 | 7/1979 | Albright | 144/3 D |

*Primary Examiner*—Robert C. Watson
*Attorney, Agent, or Firm*—Paul F. Horton

[57] ABSTRACT

Log clamping apparatus adapted for insertion between existing log conveyors and including a frame, a pair of jaws hingably engaging the frame, a pair of jacks hingably engaging the jaws and operable to open and close the jaws, and control apparatus for selectively activating the jacks. The jaws are laterally offset, hingably engaging the frame and one another, and are provided with an arcuate portion for clamping the log to prevent lateral movement and a lower, substantially planar portion operable to lift a log during the cutting process to prevent binding of the cutting saw in its contact with the log.

5 Claims, 3 Drawing Figures

LOG CLAMPING APPARATUS

BACKGROUND OF THE INVENTION

1. Field of the Invention

This invention relates, in general, to clamping devices, and in particular, to clamping apparatus for holding and lifting a log during the cutting process.

2. Description of the Prior Art

In cutting logs to length, it is a common characteristic in presently existing log mills to provide a series of log conveyors in end to end position for transporting the logs to the saw. A stop mechanism located along the top surface of a conveyor is used to hold a log from further movement on the conveyor so that an overhanging saw may cut the log to a predetermined length. Once the log has been cut the stop is removed and the cut portion may be either removed or further transported down the conveyor for later removal. In the sawing process, the saw is lowered vertically perpendicular to the axis of the log to be cut. Depending upon the thickness of the log to be cut, the saw frequently binds in its contact with the wood, causing stoppage of the saw, possible damage to the equipment, and potentially dangerous consequences to the saw operator. To prevent the resultant inefficiency due to loss of work time and repair time, logs, in some mills, are raised to prevent the binding at the sacrifice of preventing lateral movement of the log.

SUMMARY OF THE INVENTION

The present invention comprises, generally, a log clamping device including a base support; two jacks pivotally mounted to the base support; a clamp having two offset jaws, each of the jaws having an arcuate portion for clamping the log and a planar portion for lifting the log, the jaws pivotally connected to each other adjacent their terminal inner ends and pivotally connected to the jacks; and control means for activating the jacks. A more thorough description of the invention may be found in the appended claims.

It is a general object of the present invention, therefore, to provide a log clamping device with a minimum of working parts, easily insertable between existing conveyors and adapted to simultaneously clamp and lift a log for sawing.

It is a further object of the present invention to provide a log lifting and clamping device which is inexpensive, capable of handling logs of varying diameters, and which is readily placeable in existing conveyor systems.

More specifically, it is an object of the present invention to provide a log clamping device having a single set of jaws operable to lift and clamp a log into position for sawing.

Additional objects and advantages will become apparent and a more thorough and comprehensive understanding may be had from the following description taken in conjunction with accompanying drawings forming a part of this specification.

DETAILED DESCRIPTION OF THE INVENTION

Figure 1:
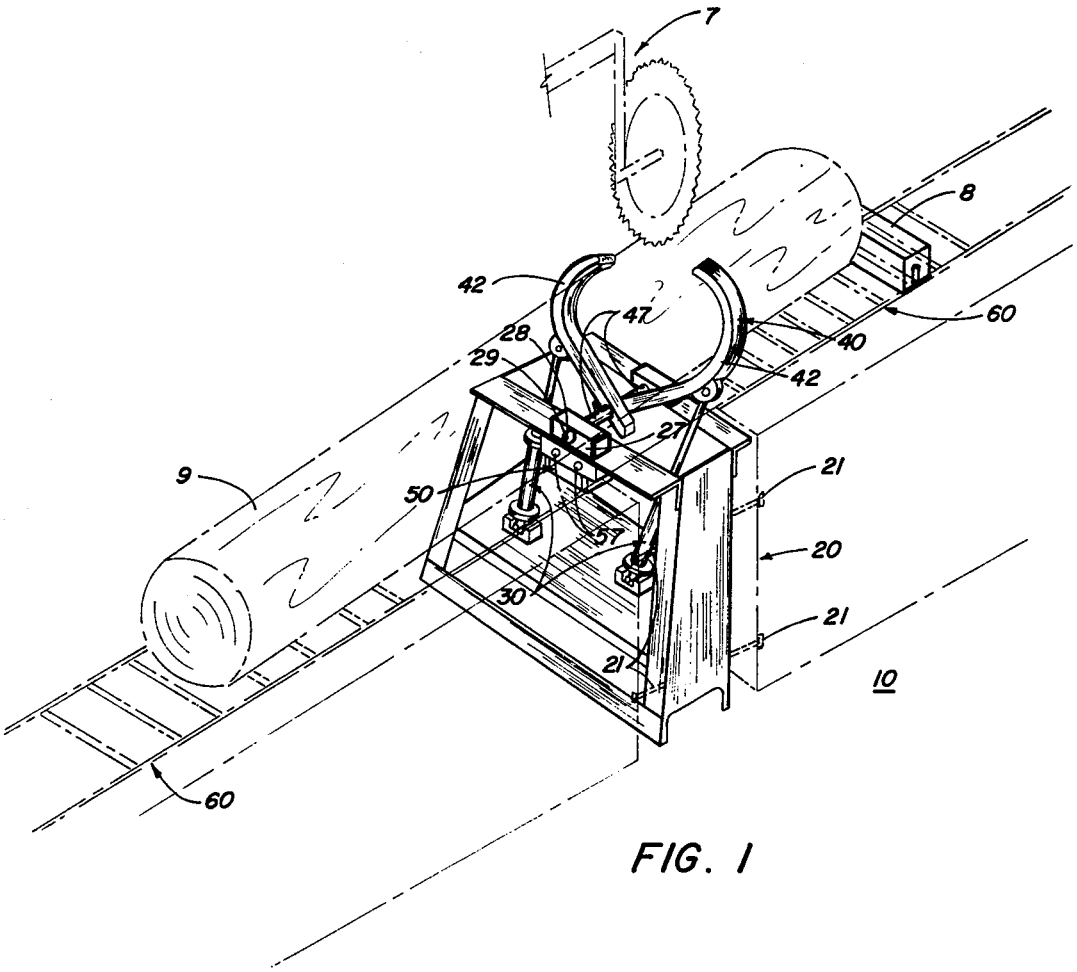
FIG. 1 is a perspective view of a preferred embodiment of the present invention as shown holding a log in preparation for cutting.

Referring now to the drawings, an embodiment to be preferred of a log clamping device 10 made according to the present invention is disclosed. Device 10 includes a base support, frame 20; a pair of lift jacks 30; log clamping means 40; and control means 50.

Supporting frame 20 is substantially rectangular in shape and of any suitable height, preferably 36 inches. Frame width is 14 inches thereby making the frame readily adaptable for insertion between existing conveyors 60. The frame is provided with a pair of legs 22 between which extends a horizontal platform 24 located at the approximate vertical midpoint of the legs, and a top platform 26. The frame may be manufactured of any suitable material and is made of channel iron in the preferred embodiment. Frame 20 is securely affixed to existing log conveyor 60 as by means of threaded bolts 21. Frame 20 is further equipped with a pair of vertically extending ears 27 having aligned shaft-receiving apertures 28.

A pair of lift jacks 30, which may be either electric or hydraulic, are pivotally mounted at their lower extremities to horizontal plate 24 in conventional manner and are pivotally attached, at their upper extremities, to pad eyes 41 by means of lock pins 31. Jacks used, may be 11 inches in length having a six inch stroke and a two inch bore.

Log clamping means 40 is provided with a pair of laterally offset clamping jaws 42 which are pivotally engaged to each other about a common shaft 29 extending between and affixed within apertures 28 or ears 27 of the frame. A pair of spacers 47 extending over shaft 29 between ears 27 and jaws 42 are provided in conjunction with a pair of interior spacers 49 and a thrust washer 48 to keep the jaws vertically parallel. Jaws 42 each include an upper substantially arcuate clamping portion 43 having a smooth concave interior surface 43' and a lower portion 44 secured to and preferably integral with the upper portion and having a smooth, substantially planar, upper, log bearing surface 44'. Jaws 42 are of sufficient width to prevent the clamps from biting into an overlying log. It has been found that a width of approximately three inches for each jaw is desireable. The jaws are constructed of plate metal and may be of any desired length, dependent upon the size of log to be lifted and clamped. Each of jaws 42 include, at substantially the juncture of upper portion 43 and lowr portion 44, a downwardly depending pad eye 41 which hingably engages shaft 33 of each jack 30, as previously noted.

Log clamping apparatus 10 is also provided with control means 50, conventional in construction, for activating jacks 30 to raise or lower clamping jaws 42, as desired. Many varying types of controls may be used in conjunction with either electric or hydraulic jacks and it is contemplated that the invention not be limited to particular controls.

Figure 2:
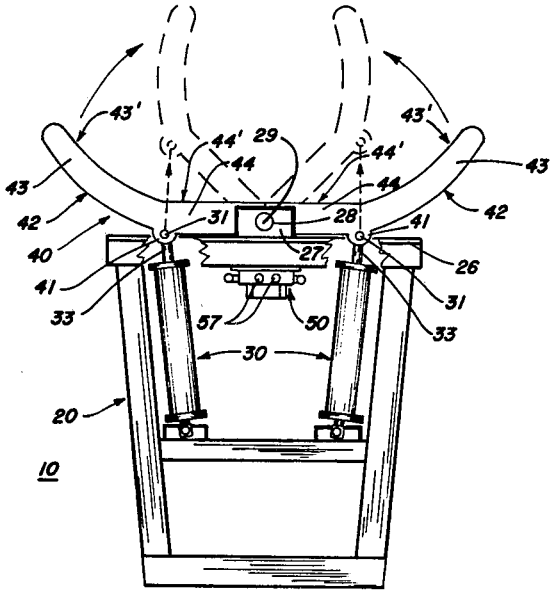
FIG. 2 is a front elevation of a preferred embodiment showing a variation in the frame.
Figure 3:
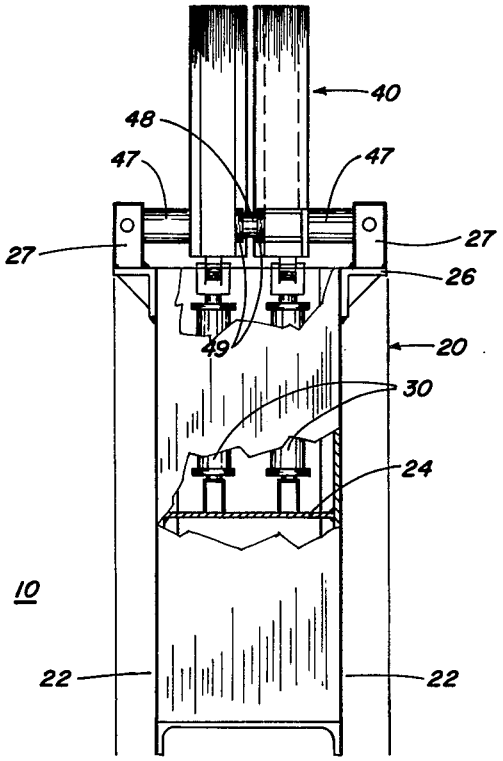
FIG. 3 is a side elevation of the apparatus of FIG. 1.

Referring now to FIG. 3, in particular, operation of apparatus 10 will be described. A log 9 is conveyed along conveyors 60 through the open jaws 42 of apparatus 10 until it reaches stop 8 which has been set to obtain a cut log of selected length. Log 9 moves through the open jaws of the apparatus without making contact because of the slight downward placement of the jaws relative to the level of the conveyor. Should contact between log 9 and the upper surface of jaws 42 take place, the log readily slips over the smooth upper surface of the jaws. Once the log comes to a rest against stop 8 the operator hits a selected button 57 of control panel 50 to activate jaws 30 simultaneously causing shaft 33, in its pivotal engagement with pad eyes 41 of jaws 42 to vertically lift and rotate the jaws about common shaft 29. Log 9 slidingly engages the smooth upper planar surface 44' of lower portion 44 of the jaws as the log is raised by the scissor effect of the cooperating jaws. For this reason, it is critical that both upper surfaces 43' and 44' be smooth to allow vertical displacement of the log without obstruction. It will be understood that height of lift can readily be varied by lengthening or shortening the width of upper surface 44'. As log 9 is lifted, the upper portion 43 of jaws 42 approach the position as shown in FIG. 1, in outline, in FIG. 2, thereby clamping and holding the log from movement in either a forward or lateral position. Once the log has been clamped, overhanging saw 7 is lowered to cut the log to the desired length, without binding. Stop 8 may then be removed, the cut log removed or conveyed, and the remaining portion of log 9 advanced to stop 8 to repeat the procedure.

Having thus described in detail a preferred embodiment of the press invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A log clamping device comprising:

base support means;

jack means pivotally mounted to said support means;

log clamping means including at least two jaws pivotally connected to said jack means, each of said jaws including an upper substantially arcuate clamping portion and a rectilinear lower portion provided with a smooth upper, substantially planar, log-bearing surface operable to slidingly engage and lift a log received thereon, said jaws each pivotally engaging one another adjacent the terminal free end of said lower portion; and control means for activating said jack means.

2. The device as described in claim 1 wherein said lower and upper portions of each of said jaws are rigidly joined and wherein each of said jaws are pivotally connected to said jack means adjacent the joinder of said upper and lower portions.

3. The device as described in claim 1 wherein each of said jaws are laterally offset from one another to prevent contact between the jaws.

4. The device as described in claim 1 wherein said base support means includes conveyor attachment means for securely and immovably fastening said support means to and between laterally spaced conveyors.

5. A log clamping device comprising:

base support means;

a pair of laterally spaced, substantially vertically extending jacks pivotally mounted to said support means;

log clamping means including a pair of laterally offset jaws, each of said jaws including an upper substantially arcuate portion having a smooth log contacting inner surface and a lower, substantially rectilinear portion rigidly joined to said upper portion, said lower portion provided with a smooth planar upper log-bearing surface operable to slidingly engage a log placed thereon, each of said jaws pivotally mounted to one of said jacks adjacent the joinder of said upper and lower portions, and each of said jaws pivotally engaging an opposing jaw adjacent the innermost terminal free end of said inner portion of said jaws operable, upon closing, to simultaneously lift and clamp a log placed thereon; and control means for simultaneously activating each of said jacks.

* * * * *